United States Patent [19]

Scharf

[11] Patent Number: 4,779,780

[45] Date of Patent: Oct. 25, 1988

[54] PLASTIC FILM WRAP DISPENSER

[76] Inventor: James E. Scharf, Box 305, Perdue, Saskatchewan S0K 3C0, Canada

[21] Appl. No.: 41,721

[22] Filed: Apr. 23, 1987

[30] Foreign Application Priority Data

Oct. 28, 1986 [CA] Canada ..... 521614

[51] Int. Cl.[4] ..... B65D 85/672

[52] U.S. Cl. ..... 225/42; 225/47; 225/90

[58] Field of Search ..... 225/42, 47, 80, 90, 225/48, 39

[56] References Cited

U.S. PATENT DOCUMENTS

| | | | |
|---|---|---|---|
| 2,319,071 | 5/1943 | Mason | 225/42 X |
| 2,554,849 | 5/1951 | Anderson | 225/42 X |
| 2,872,263 | 2/1959 | Andersson | 225/80 X |
| 3,281,032 | 10/1966 | Solomon | 225/42 X |
| 3,679,110 | 7/1972 | Stine | 225/90 X |
| 4,586,639 | 5/1986 | Ruff et al. | 225/90 X |

FOREIGN PATENT DOCUMENTS

| | | | |
|---|---|---|---|
| 2367012 | 6/1978 | France | 225/42 |
| 364714 | 11/1962 | Switzerland | 225/42 |
| 3875711 | 6/1932 | United Kingdom | 225/42 |

*Primary Examiner*—Frank T. Yost

*Attorney, Agent, or Firm*—Ciotti & Murashige, Irell & Manella

[57] ABSTRACT

Conventional film wrap dispensers have an exit slot adjacent the cutting blade so that the film end is difficult to grasp and pull out of the dispenser. The present device has a dispensing slot in the base adjacent the rear thereof and spaced from the cutter blade so that there is a two or three inch strip of plastic film extending from the slot after the previous length has been detached by said cutter blade. Furthermore, the transverse portion between the dispensing slot and the cutter blade is formed from a material which inhibits the usual adhesion of the plastic film so that the strip of plastic film extending from the dispenser slot normally hangs downwardly clear of the dispenser and does not adhere to the portion of the base between the slot and the blade as is usual. Even if some light adhesion does take place, the strip is easily detached so that it may be grasped easily for withdrawal, remote from the cut-off blade.

10 Claims, 1 Drawing Sheet

PLASTIC FILM WRAP DISPENSER

BACKGROUND OF THE INVENTION

This invention relates to new and useful improvements in dispensers for plastic film wrap.

Conventionally, such dispensers include a dispensing slot in the base of the container carrying the roll of film immediately adjacent to a serrated cut-off blade which is usually extremely sharp.

Once a length has been detached from the roll by the cutoff blade, it is difficult to grasp the free end of the roll which is usually adhered to the underside of the cut-off blade. Not only is it difficult to grasp this free end for further withdrawl of a length of film wrap, but also the cut-off blade, being relatively sharp often damages the fingers of the user.

Attempts have been made to provide a dispenser in which the dispensing slot is remote from the cut-off blade, but this means that the length of the film wrap has to be pulled forwardly, usually upon the underside of the container, in order to engage same with the cutoff blade. The length of film between the cutoff blade and the dispensing slot normally adheres firmly to the underside of the material forming the base of the container and once again it is extremely difficult to detach this short length of film without damage occurring to the fingers of the user inasmuch as the front free edge of this strip is adhered to the underside of adjacent to the relatively sharp teeth of the cutoff blade.

The present invention overcomes these disadvantages by having the dispenser slot an the cut-off blade spaced apart from one another but also by forming the underside of the dispenser between the slot and the cutoff blade, from a material which inhibits the adhesion of the film wrap thereto so that the two or three inches of film wrap normally hang downwardly from the dispenser slot thus making it easy to grasp this free end and withdraw a further length of film wrap for severing by the cut-off blade.

Even if there is some slight adhesion of the film wrap to this material forming the underside of the container, it is easily detached so that it hangs downwardly and can be grasped readily and easily.

One aspect of the invention is to provide a dispenser for plastic film wrap comprising in combination a container for a roll of plastic film wrap, means in said container for mounting said roll for rotation therein, a transversely extending dispensing slot in the base of said container adjacent the rear edge thereof, a serrated cut-off blade mounted transversely across the front of said base, said base, at least between said cut-off blade and said dispensing slot, having an outer surface which inhibits clinging attachment of said film thereto whereby a length of film hangs down from said slot substantially equal in length to the distance between said slot and said blade.

Another advantage of the present invention is to form the container of a relatively rigid and stable material so that it will readily receive a roll of film wrap which may be 1,000 feet, 1,500 feet, 2,000 feet or more, it being understood that such a roll of film wrap is relatively heavy and is difficult to support for rotation within containers made from conventional materials such as relatively thin plastic.

Another advantage of the present invention is to provide a device of the character herewithin described which includes means for mounting the roll for rotation within the container and which is easily inserted into the container so that the free end of the roll extends vertically downwardly from the roll and through the discharge slot adjacent the rear of the base of the container.

Another advantage of the present invention is to provide a device of the character herewithin described in which the container can be supported upon the underside of a horizontal surface such as a kitchen cupboard or the like, or, alternatively, can be mounted against a vertical supporting surface such as a wall or the like.

Still another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
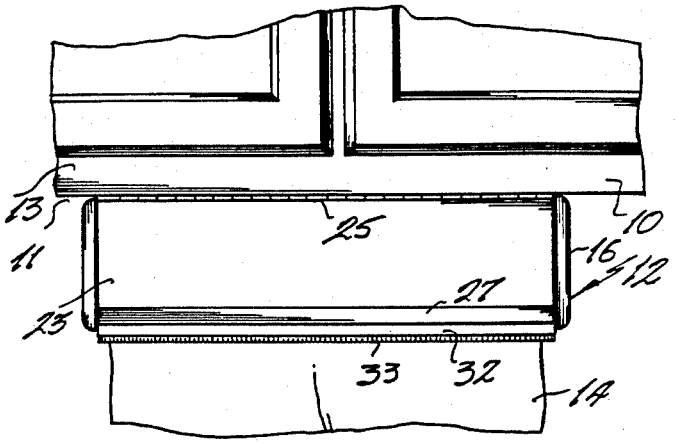
FIG. 1 is a fragmentary front elevation of a kitchen cabinet with the device attached to the underside thereof.
Figure 3:
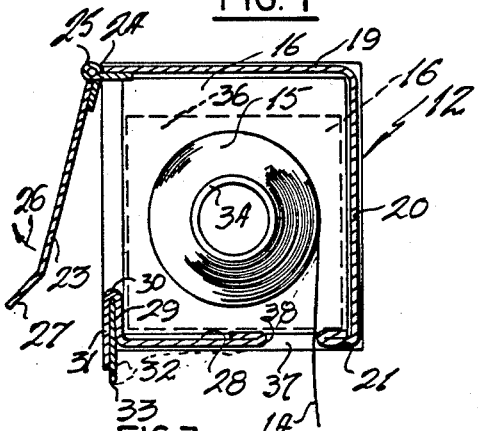
FIG. 3 is a transverse cross-sectional view of the device.
Figure 2:
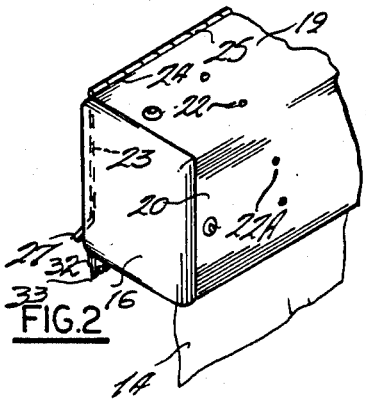
FIG. 2 is a fragmentary isometric rear view of one end of the device.
Figure 5:
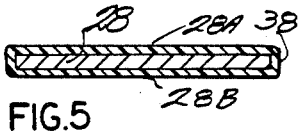
FIG. 5 is an enlarged cross-sectional view of the base panel of the device.
Figure 4:
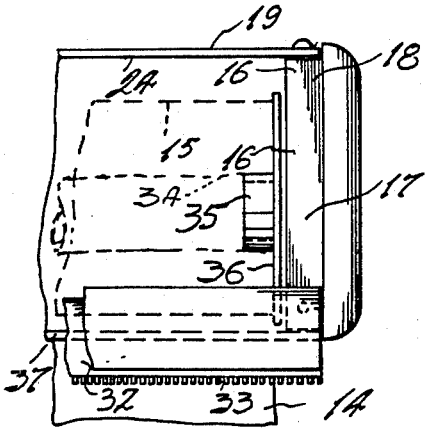
FIG. 4 is a fragmentary front elevation of one end of the device with the front removed.
Figure 6:
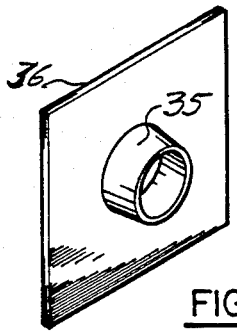
FIG. 6 is an isometric view of one of the film wrap roll supports per se.

Proceeding therefore to describe the invention in detail, reference should first be made to FIG. 1 which shows in fragmentary form, a kitchen cabinet 10 having an undersurface 11.

The dispenser collectively designated 12 is mounted upon the underside 11 adjacent the front 13 of the cabinet and depends downwardly therefrom for easy access to the free end 14 of the plastic film wrap roll 15 as will hereinafter be described.

The dispenser 12, which is rectangular in cross-section, includes a pair of rectangular ends 16 prferably made of wood and having rectangular flanges 17 extending upon one side thereof thereby defining right angled grooves or shouldered recesses 18 around all four sides.

The container or enclosure is preferably made from enamalled steel or the like in order to give sufficient rigidity to the container to support the weight of a relatively large roll of film wrap 15.

It consists of a rectangular elongated upper panel 19, a rectangular elongated rear vertical panel 20 preferably formed integrally with the upper panel 19 and a relatively short elongated horizontal base panel portion 21, once again preferably formed integrally with the panels 19 and 20 as clearly shown.

Apertures 22 are formed in the upper panel to permit the attachment of the container to the underside supporting surface 11 by means of screws or the like (not illustrated), or, alternatively, apertures 22A are formed in the rear panel 20 so that it may be secured by screws or the like to a vertical surface such as a wall (not illustrated).

The front panel 23 is also rectangular and elongated and is hinged across the front edge 24 of the upper panel 19 by means of a hinge 25 so that it can be moved manually in the direction of arrow 26 and, when released, normally falls to the vertical position due to gravity. The lower free edge 27 of this front panel is preferably curved outwardly slightly in order to enable the fingers of the user to engage this free lower edge and raise the lid in the direction of arrow 26.

The main portion 28 of the base is preferably formed from steel and is covered by a vinyl layer 29 which inhibits the adhesion thereto of the film wrap end portion 14. This material is manufactured by Stelco Ltd. under the trademark "PLASTISOL" which is a steel sheet coated with vinyl of various colours. Other materials with film adhesion limiting properties may be used.

The base 28 is provided with an elongated transversely extending front lip or strip portion 29 extending upwardly at right angles to the plane of the main portion 28A and is then counter-angulated as at 30 and extends downwardly as as 31 clamping a cut-off blade 32 therebetween. The cut-off blade is preferably formed form steel and is provided with a transversely extending serrated lower edge 33 for cut-off purposes which extends just below the plane of the undersurface 28B of the base portion 28 as clearly shown in the drawings (shown exaggerated in the drawings).

The aforementioned roll of plastic film wrap 15 is normally wound on a cardboard core 34 and is supported in the container by a pair of cylindrical hubs 35 secured to or formed integrally with rectangular panels 36, with the hubs 35 extending upon one side thereof. The dimensions of the rectangular panels 36 is such that they will engage through the front of the dispenser between the upper counter-angulated edge 30 of the strip 27 and the hinge 25 and will then drop down onto the base 28 to be retained from forward displacement through the front of the dispenser, by the aforementioned strip 29 and 31.

In operation, the plastic film wrap roll is mounted upon the hubs 35 whereupon the two hubs and plates 36 together with the film wrap roll are inserted through the front of the dispenser so that the lower edges of the plates 36 register upon the inner surface 28 of the floor or base.

The free end 14 of the roll of film wrap is fed downwardly through the dispenser slot 37 defined by the rear edge 38 of the base portion 28 and the front edge 39 of the base portion 21, said slot being adjacent the rear of the base of the despenser.

When it is desired to detach a length of film wrap from the roll, the free end 14 is grasped by the hand and pulled downwardly until sufficient film wrap has been unrolled from the roll 15. It is then pulled forwardly and then upwardly and across the serrated edge 33 of the cut-off blade thus cleanly severing the desired length. The portion of film wrap extending between the slot 37 and the serrated edge 33 normally drops downwardly by gravity to the position shown in FIG. 1 but even if some slight adhesion remains between this free length of film and the underside surface 28B, it is easily detached and freed from this surface without any danger of damage to the fingers of the operator. This may be accomplished at each end of the container rearwardly of the blade 32 and formed between the front portion of the free end of the wrap and the base of the container because the lower edge of the blade is situated below the plane of the underside of the blade.

Since various modifications can be made in my invention as hereinable described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A dispenser for plastic film wrap comprising in combination a container for a roll of plastic film wrap and including an upper side and a base, means in said container for mounting said roll for rotation therein, a transversely extending dispensing slot in the base of said container adjacent the rear edge thereof, a vertically situated cut-off blade having a serrated lower edge mounted transversely across the front of said base with said serrated edge being below the plane of said base, said base, at least between said cut-off blade and said dispensing slot, having an outer surface which includes means to inhibit clinging attachment of said film thereto whereby a length of film hangs down from said slot substantially equal in length to the distance between said slot and said blade, said means to inhibit clinging attachment of said film comprises said outer surface of said base having a vinyl plastic coating.

2. The dispenser according to claim 1 in which said container is securable to a horizontal support by the upper side thereof for dependency from said horizontal support.

3. The dispenser according to claim 2 which includes a retainer strip extending across the front of the base of said container and extending upwardly therefrom to detachably retain the associated roll of film within said container.

4. The dispenser according to claim 3 in which said strip forms a continuation of said base, extending upwardly and then counter-angulating back downwardly, said cut-off blade being clamped between the upwardly and downwardly extending portions forming said strip.

5. The dispenser according to claim 4 in which said means for mounting said roll for rotation therein includes a hub engaging within each end of said roll and a substantially rectangular plate for each hub, said hub being secured centrally of said plate and extending upon one side thereof, the dimensions of said plate being less than the internal cross-sectional dimensions of said container.

6. The dispenser according to claim 3 in which said means for mounting said roll for rotation therein includes a hub engaging within each end of said roll and a substantially rectangular plate for each hub, said hub being secured centrally of said plate and extending upon one side thereof, the dimensions of said plate being less than the internal cross-sectional dimensions of said container.

7. The dispenser according to claim 2 in which said means for mounting said roll for rotation therein includes a hub engaging within each end of said roll and a substantially rectangular plate for each hub, said hub being secured centrally of said plate and extending upon one side thereof, the dimensions of said plate being less than the internal cross-sectional dimensions of said container.

8. The dispenser according to claim 1 in which said container includes a front wall including an upper edge, hinged to said container by said upper edge thereof thereby forming a hinged cover providing access to the interior thereof.

9. The dispenser according to claim 8 in which said means for mounting said roll for rotation therein includes a hub engaging within each end of said roll and a substantially rectangular plate for each hub, said hub being secured centrally of said plate and extending upon one side thereof, the dimensions of said plate being less than the internal cross-sectional dimensions of said container.

10. The dispenser according to claim 1 in which said means for mounting said roll for rotation therein includes a hub engaging within each end of said roll and a substantially rectangular plate for each hub, said hub being secured centrally of said plate and extending upon one side thereof, the dimensions of said plate being less then the internal cross-sectional dimensions of said container.

* * * * *